US007141139B2

(12) United States Patent
Meinander et al.

(10) Patent No.: US 7,141,139 B2
(45) Date of Patent: Nov. 28, 2006

(54) MULTIPLE CLEANING STAGES WITH VARIOUS DILUTION POINTS AND ACCEPTS RECIRCULATED THROUGH A COMMON PIPE

(75) Inventors: Paul O Meinander, Grankulla (FI); Juha Lahti, Helsinki (FI); Risto Nykanen, Helsinki (FI)

(73) Assignee: Pom Technology Oy AB, Helsinki (FI)

( * ) Notice: Subject to any disclaimer, the term of this patent is extended or adjusted under 35 U.S.C. 154(b) by 168 days.

(21) Appl. No.: 10/258,064

(22) PCT Filed: Apr. 12, 2001

(86) PCT No.: PCT/FI01/00366

§ 371 (c)(1),
(2), (4) Date: Mar. 18, 2003

(87) PCT Pub. No.: WO01/81674

PCT Pub. Date: Nov. 1, 2001

(65) Prior Publication Data

US 2003/0159785 A1 Aug. 28, 2003

(30) Foreign Application Priority Data

Apr. 19, 2000 (FI) ..... 20000940

(51) Int. Cl.
*D21D 5/00* (2006.01)
*D21D 5/24* (2006.01)
*D21F 1/06* (2006.01)

(52) U.S. Cl. ..... 162/55; 162/212; 162/315; 209/729

(58) Field of Classification Search ..... 162/55, 162/199, 202, 212, 272, 315, 336; 209/1, 209/2, 10, 728, 729
See application file for complete search history.

(56) References Cited

U.S. PATENT DOCUMENTS

| | | | | |
|---|---|---|---|---|
| 3,301,745 | A * | 1/1967 | Coppick et al. | 162/55 |
| 4,676,809 | A * | 6/1987 | Fjallstrom et al. | 96/209 |
| 5,112,444 | A * | 5/1992 | Henricson et al. | 162/55 |
| 5,593,542 | A * | 1/1997 | Wolfer et al. | 162/4 |
| 5,776,304 | A * | 7/1998 | Vikio | 162/4 |
| 5,861,052 | A * | 1/1999 | Meinander | 95/243 |
| 6,003,683 | A * | 12/1999 | McCarthy | 209/727 |
| 6,080,274 | A * | 6/2000 | Hautala et al. | 162/55 |
| 6,186,333 | B1 * | 2/2001 | Hautala et al. | 209/17 |
| 6,416,622 | B1 * | 7/2002 | de Jong | 162/55 |

FOREIGN PATENT DOCUMENTS

WO WO 9850624 A1 11/1998

OTHER PUBLICATIONS

G.A. Smook, Handbook for Pulp & Paper Technologists, 1982, TAPPI and Canadian Pulp and Paper Association, p. 106.*
K. Britt, Handbook of Pulp & Paper Technology, 1970, Van Nostrand Reinhold Co., 2nd edition, pp. 216-220.*

* cited by examiner

*Primary Examiner*—Steven P. Griffin
*Assistant Examiner*—Anna L. Kinney
(74) *Attorney, Agent, or Firm*—Browdy and Neimark, PLLC

(57) ABSTRACT

In a process and an arrangement for directing a papermaking pulp towards a regulated outlet (9), accept from successive cleaning stages (6, 14, 20) is totally or partly led towards the outlet (9) while excess accept is led in the opposite direction to the inlet (5) of the preceding cleaning stage (6). For feeding of a forming wire, a common base pipe (8) for collecting accept extends between the outlet (9) and a feeding (3) for fresh pulp, while reject pipes (11, 18) lead to the next cleaning stage (14, 20).

3 Claims, 3 Drawing Sheets

Figure 1:
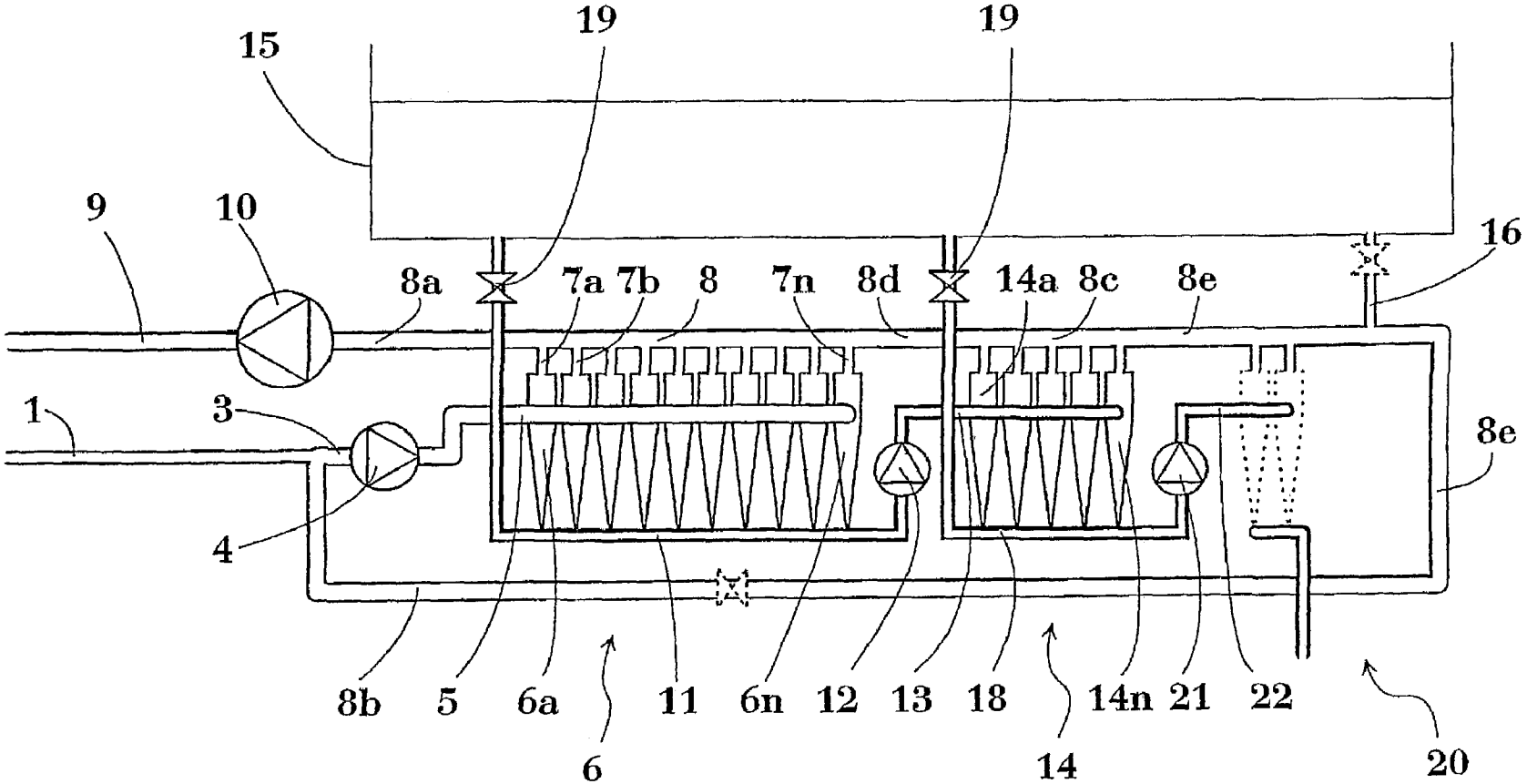

MULTIPLE CLEANING STAGES WITH VARIOUS DILUTION POINTS AND ACCEPTS RECIRCULATED THROUGH A COMMON PIPE

The present invention relates to a process for directing a pulp, especially a papermaking pulp or the like substance comprising a liquid and components of a more solid character towards a controlled outlet, suitably further to a forming wire in a papermaking machine, whereby said pulp is led via a feeding point to a first cleaning stage from which the accept is primarily led towards said outlet.

The present invention also relates to an arrangement for the feeding of a forming wire in a papermaking machine, said arrangement comprising means for feeding or addition of pulp, especially a papermaking pulp or the like substance comprising a liquid and components of a more solid character, a controlled outlet, a first cleaning stage and pump means for feeding said pulp via an inlet to said first cleaning stage, whereby at least one accept outlet is connected to a base pipe whose one end is connected to said outlet. The invention also relates to an arrangement for the cleaning of a pulp, said arrangement comprising an inlet controlled by a regulating device for the feeding of a first cleaning stage and an outlet controlled by a regulating device and leading to consumption, suitably to a forming wire in a papermaking machine.

The present invention concerns especially but not exclusively the treatment of pulp which is led to a head box at a wire for forming a web of paper pulp which is thereafter processed to paper. The pulp should be as free of irrelevant components as possible since it is such components which in the end cause damages in the end product. For this reason, the cleaning of the pulp at this stage comprises an essential part of the processing. Prior known arrangements for the cleaning of paper pulp and the like substances generally comprise successively arranged cleaning stages wherein each stage includes one or several cleaning apparatuses, generally of the cyclone type having an inlet for raw pulp, an outlet for accept and an outlet for reject. By arranging several such stages consecutively in different ways a better cleaning of the in-flowing pulp is achieved and consequently a more pronounced separation of the components which form accept and reject, respectively.

In the prior art systems it is usual to direct the accept from the primary cleaning apparatus via a screen directly to the head box, while the reject is directed back to a secondary cleaner whose accept is directed to the primary cleaner and whose reject is discharged or directed to further treatment. The system generally also includes special degassing and mixing arrangements for improving the quality of the pulp as regards homogeneity and air content. The system is generally balanced with the aid of a back water tank. The person skilled in the art is familiar with one-pump and two-pump systems, recirculation via wire pits and arrangements with open cascades, which need not be described in greater detail in this context.

It is typical for the above mentioned prior art arrangements that they are static in nature which, on the other hand, limits the flexibility of the system. The expression static is here intended to mean i.a. that the prior art systems are not capable of adapting to changed processes without significant operations being undertaken and that they often cannot be adapted to adjusted operational conditions even when the process remains unchanged. The flow through a cleaning plant is structurally of a constant type, i.e. it is dependent on the pressure and on the number of individual cleaning apparatuses in the plant. In order to achieve optimal flexibility, the production process itself would, on the other hand, require a variable flow for instance to the head box. Because of the above mentioned limitations in the prior known arrangements the flow balance has, until the present date, been problematic and has caused limitations in the dimensioning and flexibility of the systems. Partly due to this lack of flexibility, the prior known arrangements are typically sensitive to operational disturbances which may occur for different reasons. Sometimes the cleaning arrangements themselves may cause operational disturbances which often have severe consequences for the production. In addition to the aforementioned draw backs the prior art has a high energy consumption which usually is caused by the complicated systems, by the large amounts of liquid and the large liquid flows as well as by a disadvantageous utilization of earlier introduced energy. At the same time the prior art arrangements have in practice allowed very limited possibilities for varying the dimensioning.

The object of the present invention is to solve the above mentioned problems and to provide a cleaning arrangement which is flexible. A special object is the provision of an arrangement wherein the system can easily be dimensioned in an optimal way with adaption to different operational situations, product qualities and product volumes.

According to the invention the problems are solved by that which is disclosed as characteristic in the appended claims. The process according to the invention is characterized in that the reject from a respective preceding cleaning stage is led for further treatment to the inlet of at least one succeeding cleaning stage whereby, depending on the operational situation, the accept from said preceding cleaning stage as well as accept from said at least one succeeding cleaning stage is induced, in turn, to be directed, on one hand, totally or partly towards said outlet while, on the other hand, those portions of said accept which are not directed towards said outlet are induced to be directed in the opposite direction towards said feeding to said preceding cleaning stage. The reject from the first cleaning stage is thus suitably directed for further treatment in at least one and preferably several correspondingly consecutive subsequent cleaning stages.

The accept from respective consecutively arranged cleaning stages is suitably directed to a base pipe which is suitably common for all accepts from all cleaning stages. The base pipe leads the accept towards the outlet to the extent allowed by the regulating means. The same base pipe also leads in the opposite direction towards the feeding of the first cleaning stage, i.e. substantially to the same point in which the system is also fed fresh pulp from outside. Diluting water is preferably also introduced respectively into said base pipe and into the respective reject outlet from at least the first cleaning stages. Said diluting water is mixed into the pulp along the extension of the pipe in order to provide the desired consistency.

The feeding arrangement according to the invention is characterized in that the reject outlets from the preceding cleaning stages are connected via a respective collecting reject pipe to a respective inlet of at least one succeeding cleaning stage whose respective accept outlet, in its turn, is connected to an extension of said base pipe, said extension at its other end, in its turn, being connected to said entrance to said pump means for feeding of pulp to said inlet.

The cleaning arrangement according to the invention is characterized in that it comprises at least one second cleaning stage such that the accept outlets from the respective cleaning stages are consecutively connected to a common base pipe one end of which is connected to said controlled outlet and the opposite end of which is connected to an entrance to said regulating device for the feeding of said preceding cleaning stage, while the respective reject outlet from at least one preceding cleaning stage is connected to an inlet to a respective succeeding cleaning stage.

Depending on the operational situation, the accept from a preceding cleaning system, usually the first cleaning system in the series, is thus led so that it completely or partly adds to the first pipe which leads to the regulated outlet. In case the operation does not allow receiving of all of the cleaned amount, the excess is directed in the opposite direction, i.e. it is returned to the point where pulp is introduced and thus back to the inlet of a cleaning system which is situated earlier in the flow direction and which also in this case usually is the inlet of the first one in the series. Pump means operate at said inlet and force the pulp introduced into the system to said earlier cleaning or enriching stage from which the first accept thus is primarily led towards the regulated outlet. In case the outlet does not either allow receiving of all of this accept, accept is taken from the individual cleaners of the cleaning stage in the order that these outlets are connected to the base pipe. In an extreme case when the outlet is totally throttled, all accept is led back to the inlet and thus recirculates in the system. This arrangement makes it possible to dimension the whole cleaning process with its cleaning stages in a totally new way which will be described in greater detail below. The amount of pulp which is led to the outlet is controlled by the regulating devices, e.g. valves and/or pumps, while excess pulp may recirculate. In this way it is thus fully possible to dimension the cleaning stages theoretically substantially independently of the amount of pulp which is led to the outlet.

The respective cleaning stages normally comprise several cleaners and according to the invention the feeding towards the regulated outlet is performed by first directing thereto the accept from the first cleaner, thereafter from the next cleaner and so on. The accept from all those cleaners, for whose accept there is not room in the flow towards the outlet, is directed in the opposite direction in one and the same pipe, said pipe having one end connected to the outlets while the other end finally ends in the inlet to the first cleaning stage. According to the invention, the reject from the respective cleaning stages is directed, for so long as said reject can be considered likely to contain acceptable components, to the inlet of the succeeding cleaning stage. Diluting liquid is suitably simultaneously introduced in order to make this reject more easily flowing and at the same time in order to thereby influence the liquid balance of the whole system. The total mass balance of the system is, on the other hand, controlled by the regulated outlet, by the introduction of pulp at the first cleaning stage and by the removal of final reject from the last cleaning stage.

In the following the invention will be illustrated with an example of embodiments with reference to the appending drawings, wherein FIG. 1 very schematically shows the general principle of the arrangement according to the present invention, FIG. 2 also schematically, but in greater detail, discloses an embodiment of the invention, and FIG. 3 in a perspective view illustrates an embodiment of the invention.

With reference to FIG. 1 the arrangement according to the invention comprises an inlet 1 for fresh pulp. This pulp will typically have a concentration of about 3–5% calculated on the dry substance. The inlet 1 which may include pump means and/or other control means 2, which are known per se, is connected to an inlet 3 of a pump 4 which in turn feeds the first cleaning stage via a feeding pipe 5. The first cleaning stage is generally designated 6. In the shown case which corresponds to a suitable embodiment, the cleaning apparatus consists of several cyclone separators 6*a* . . . 6*n* arranged in parallel. Also other arrangements which, for instance, comprise a single separator are possible within the scope of the invention.

From the first cleaning stage 6 the accept is directed, in the illustrated case via accept pipes 7*a*, 7*b* . . . 7*n* which are arranged separately for each cleaner, to a common base pipe 8, which at its one end 8*a* directs the pulp to the outlet 9 and finally to the forming wire (not shown) of the papermaking machine, advantageously via a screening device or the like. This pulp typically has a concentration of 0.1 to 2%, usually about 0.5 to 1%. Between the end section 8*a* of the pipe and the outlet 9 there is provided means for regulating the pulp stream in the direction towards the outlet 9. According to FIG. 1 said regulating means comprise pump means 10 but they can also comprise valve means (not shown), which can be used to control the amount of pulp which leaves the system and which are primarily used for controlling the production and for maintaining the balance in the process. The other end 8*b* of the base pipe 8 is, in its turn, connected, suitably via a bypass valve for pressure regulation, to the inlet 3 from which pulp is directed by pump means 4 to the inlet or feeding pipe 5 of the first cleaning stage 6. Pulp from the accept outlets such as said accept pipes 7*a*, 7*b* . . . 7*n* can thus move in both directions, i.e. primarily towards the outlet 9, which in FIG. 2 is shown with a compact line arrow, and secondarily towards the feeding to the first cleaning stage 6, which correspondingly is shown with a broken line arrow.

The reject from a preceding cleaning stage, in the shown case comprising the first cleaning stage 6, is led via a first reject pipe 11, generally with the aid of pump means 12 to the inlet 13 of the next cleaning stage, which in the shown embodiments comprises the second cleaning stage 14. In the embodiment according to FIG. 1 said cleaning stage 14 also comprises several cleaning apparatuses 14*a* . . . 14*n* which in the shown example are cyclones known per se, but which also can consist of some other cleaning arrangement. According to the invention the accept from said second cleaning stage 14 is now led via a section 8*c* of the base pipe 8. Said pipe section 8*c* is situated, as seen from the outlet 9, behind the accept outlets or accept pipes 7*a*, 7*b* . . . 7*n* after the first cleaning stage 6. One end of the pipe section 8*c* connects to the pipe section to which the accept pipes 7*a*, 7*b* . . .7*n* lead and pipe section 8*c* thus finally leads towards the outlet 9. The other end of the pipe section 8*c* is, on the other hand, finally connected to the inlet 3 for pulp at the other end 8*b* of the base pipe 8 and pulp can thus move in said pipe section 8*c* in both directions.

In certain embodiments the base pipe 8 comprises regulating devices at one or more sections. Such devices may, for instance be valves or the like in order to forcibly control the flows of pulp and diluting liquid, respectively, at need. Such diluting liquid is introduced at need in different points in the base pipe 8 and/or in the pipes directing reject from one cleaning stage to the next. FIG. 1 shows that diluting liquid can be taken, for instance, directly from a back water tank 15 via a pipe 16 for introduction of diluting liquid and connected to the base pipe 8, while FIG. 2 shows that diluting liquid is introduced with the aid of one or more, suitably degassing pumps 17. Primarily the dilution water introduction is arranged in the connecting pipe section 8*d* or 8*e*, respectively, which extends between the accept outlets from respective cleaning stages 6, 14, but introduction of diluting water may also be performed in the reject pipes 11 or 18, respectively, for diluting the reject, as shown in FIG. 1. In this case the introduction is suitably regulated by valves 19 and/or by controlling the respective pump 17. As shown in FIG. 1, the system may at need further comprise one or more additional cleaning stages 20 which are suitably fed with reject from the preceding cleaning stage 14 via pump device 21 and inlet 22 and whose accept and reject, respectively, can be directed in the above described way or in some other way.

The arrangement can be described as a series of successively interconnected feeding points for different kinds of introduced liquids such that, for instance, the head box at a forming wire in a papermaking machine is primarily fed with the accept from the first cleaning stage 6 said accept being fed towards the outlet 9 via the base pipe 8. The same feeding pipe, that is the base pipe 8 also feeds accept from the second cleaning stage 14 in the direction towards the same outlet 9, and thereafter diluting water is introduced, still via the same base pipe 8 as will be described in greater detail below. The flow in the system is primarily provided with the aid of pump means 4 which also add fresh pulp from the feeding inlet 1 as pulp is fed on towards the outlet. The flow leaving the system at outlet 9 is determined by the flow rate ordered by the regulating device such as said pump means 10. The accept flow from the cleaner 6*a*, which in the direction of the flow lies first, will primarily feed the outlet 9 whereafter follows accept from the subsequent cleaners 6*b* . . . 6*n* in the first cleaning stage 6. In case the flow through outlet 9 so allows the accept from the following cleaning stage 14 will also flow towards said outlet 9. The accepts from such cleaners 14*n*, which in the direction of the flow are later than those which feed the outlet 9 in accordance with the total amount accepted by the regulating device such as said pump means 10, will in turn be fed in the opposite direction, i.e. towards the pump 4 at the inlet or feeding pipe 5 to the first cleaning stage 6. Due to the arrangement according to the invention, the running of the process becomes substantially insensitive to the exact amount of pulp passing the outlet since any excess pulp is returned to the inlet 3 of the arrangement and thus recirculates in the system in an almost continuous cleaning.

Thus, the system according to the invention provides an alternative flow path due to the fact that the accept from the second cleaning stage 14, and in some cases also at least a part of the accept from the first cleaning stage 6, may totally or partly recirculate in the common base pipe 8 even in an opposite direction, i.e. away from the outlet 9. In this alternative flow direction said accept is led via the other end 8*b* of the base pipe 8 directly to the feeding point such as said inlet 3 for fresh pulp. Thus in case the controlling means such as said pump means 10 totally shut the outlet 9, all material will recirculate through the cleaning stages and nothing but reject from the last cleaning stage 20 leaves the system. In order to control the consistency and/or compensate for the removal of liquid, diluting liquid is introduced, for instance, through the pipe 16 for introducing a diluting liquid such as water and through the inlets connected to the reject pipes 11, 18 so that a totally dynamic balance can be continuously achieved in the system even when the outlet 9 is totally shut, e.g. at a change of quality or because of a disturbance in the operation. At the same time a continuous cleaning of the pulp takes place according to the invention since the successively arranged cleaning stages 6, 14 feed accept to the base pipe 8 and reject to the respective succeeding cleaning stages 14, 20.

The arranging of such a possibility for the material flows to move in both directions achieves a heretofore unknown flexibility as regards the possibilities to exactly control the process wholly in accordance the needs set by the production outside the system in question. The feeding of cleaned pulp can in practice be varied in a stepless manner between zero and the full capacity of the outlet 9. Thus, the feed-back according to the invention provides a freedom to dimension the plant also within a range which until now has been impossible. According to the present opinions based on the prior art, the capacity of the first and second stages must either be kept about 10% smaller than the minimum outlet flow in order to enable a satisfactory dilution according to the prior art, or the capacity must be at least 10% higher than the maximum flow in order to guarantee the functioning of the process irrespective of a recirculation. These limitations have in practice necessitated, on one hand, a maximal dimensioning according to a minimum or a minimal dimensioning according to a maximum although the optimal dimensioning often lies within a range which cannot be achieved.

The arrangement according to the invention lacks all of the above limitations which, in itself, must be regarded as highly surprising. The arrangement according to the invention allows a dimensioning of the system totally in accordance with the requirements set by the production and, for instance, by a desired optimal pulp consistency. Thus, the cleaning arrangement can be run at full effect within the desired consistency range without necessitating an over-dimensioning of the system, which was the case with the prior art.

The material flows in the arrangement according to the invention have a definite hierarchical structure which, moreover, may be steplessly varied according to the prevailing operational situation. Thus, the invention enables the maintaining of a variable pulp flow to a former or the like while the pulp flow through the cleaning stages is at the same time held at a substantially constant level. It may be generally noted that in case of large material flows, one primarily utilizes the accept from the first cleaning stage 6 and secondarily the accept from the second cleaning stage 14, etc., whereafter one only as the last resource introduces diluting water, e.g. by means of said pipe 16. In case of small flows, on the other hand, one utilizes only a part of the material from the first cleaning stage 6 while its excess is fed back to the pump 4. Pump 4 will thus primarily pump pulp from the feeding inlet 1, next it will pump excess from the later cleaning stages 20 and 14, then excess from the cleaning stage 6 and only as the last resource will it pump diluting water. This arrangement thus as such provides an optimal utilization of the material from the various stages.

Figure 2:
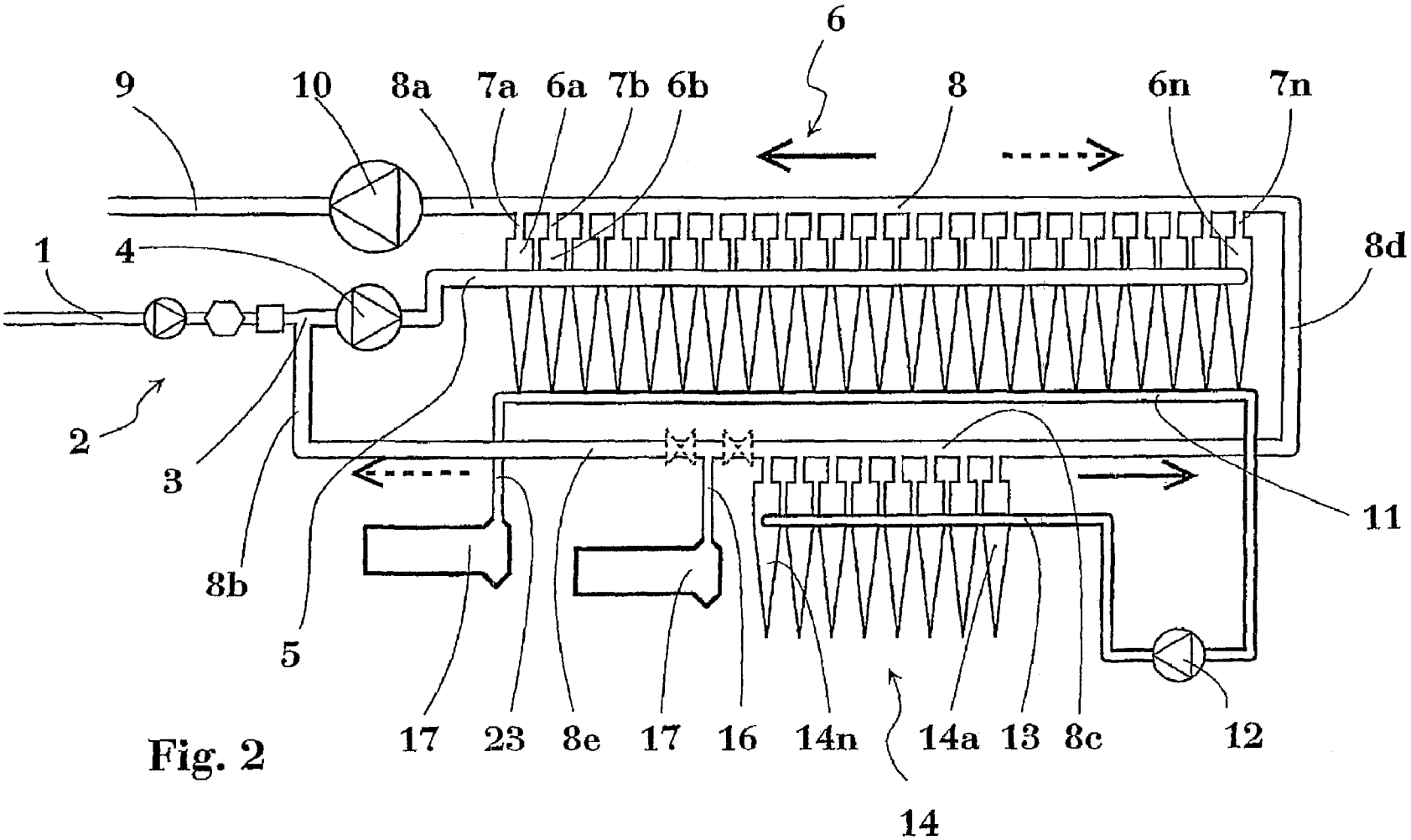

FIG. 2 shows another example of how the arrangement may be construed in practice. Pulp is fed into the system from a conventional stock preparation which is not shown in detail. The feeding is preferably done via suitable pumping and controlling devices 2 of a kind which is known per se. The, feeding is suitably performed at an introduction point such as said inlet 3 at the inlet to a feeding and recirculating pump 4 which controls the system and keeps the pulp in a continuous flowing movement. The outlet of the pump 4 is connected to a feeding pipe 5 which in the shown case feeds a number of cyclone cleaners 6*a* . . . 6*n* arranged in parallel. The cleaners 6*a* . . . 6*n* form together the first cleaning stage 6 and their outlets are connected to the common base pipe 8, whose outlet end 8*a* leads to the outlet 9 via a second pump, i.e. said pump means 10 which preferably has an adjustable capacity. According to an alternative embodiment the cleaners 6*a* . . . 6*n* may also be connected to parallel base pipes (not shown) which lead the pulp onwards in the corresponding way.

Reject from the cleaners 6*a* . . . 6*n* is suitably lead via a common collecting reject pipe 11 and pump means 12 to an inlet feeding pipe 13 for the next cleaning stage 14, which comprises cleaners 14*a* . . . 14*n*, whose reject is discarded or led to the next cleaning stage (not shown) In the shown embodiment, a pipe 23 is also provided for the feeding of diluting liquid into said collecting reject pipe 11. The accept from the second cleaning stage 14, which is composed of the cleaners 14*a* . . . 14*n*, is suitably led to a section 8*c* of the common base pipe 8, in which the said accept can now be led in either direction, i.e. on one hand via an intermediate pipe section 8*d*, which leads to the connections for the accept pipes 7*a* . . . 7*n* from the first cleaning stage 6 and further towards the regulating pump means 10 and from there towards the outlet 9. In FIG. 2 this primary flow direction is shown by an unbroken direct arrow. On the other hand, in case the outlet 9 is throttled or shut, the accept from the first cleaning stage 6 may also use the same pipe section 8*d*, although in the opposite direction and past the accept outlet of the second cleaning stage 14 which flows out into pipe section 8*c*. In FIG. 2 this is shown by a broken line arrow.

The accept from the second cleaning stage 14 also has an alternative path, i.e. directly via a pipe 8*e* in the direction towards the feeding 3 for fresh pulp. In this direction the accept from the first cleaning stage 6 can thus also flow in case the outlet 9 is throttled because the production so requires.

As is made evident by FIG. 2 the main introduction 16 of diluting liquid is suitably arranged in the pipe extension 8*e*, whereby it is possible to achieve a well balanced dilution of the flows, on one hand, through the relatively long collecting pipe 8 and, on the other hand, through the influence of the pump 4 which causes the circulation. The introduction of diluting liquid is preferably performed with degassing pumps 17 of the kind described in greater detail e.g. in the same inventor's U.S. Pat. No. 5,861,052.

Figure 3:
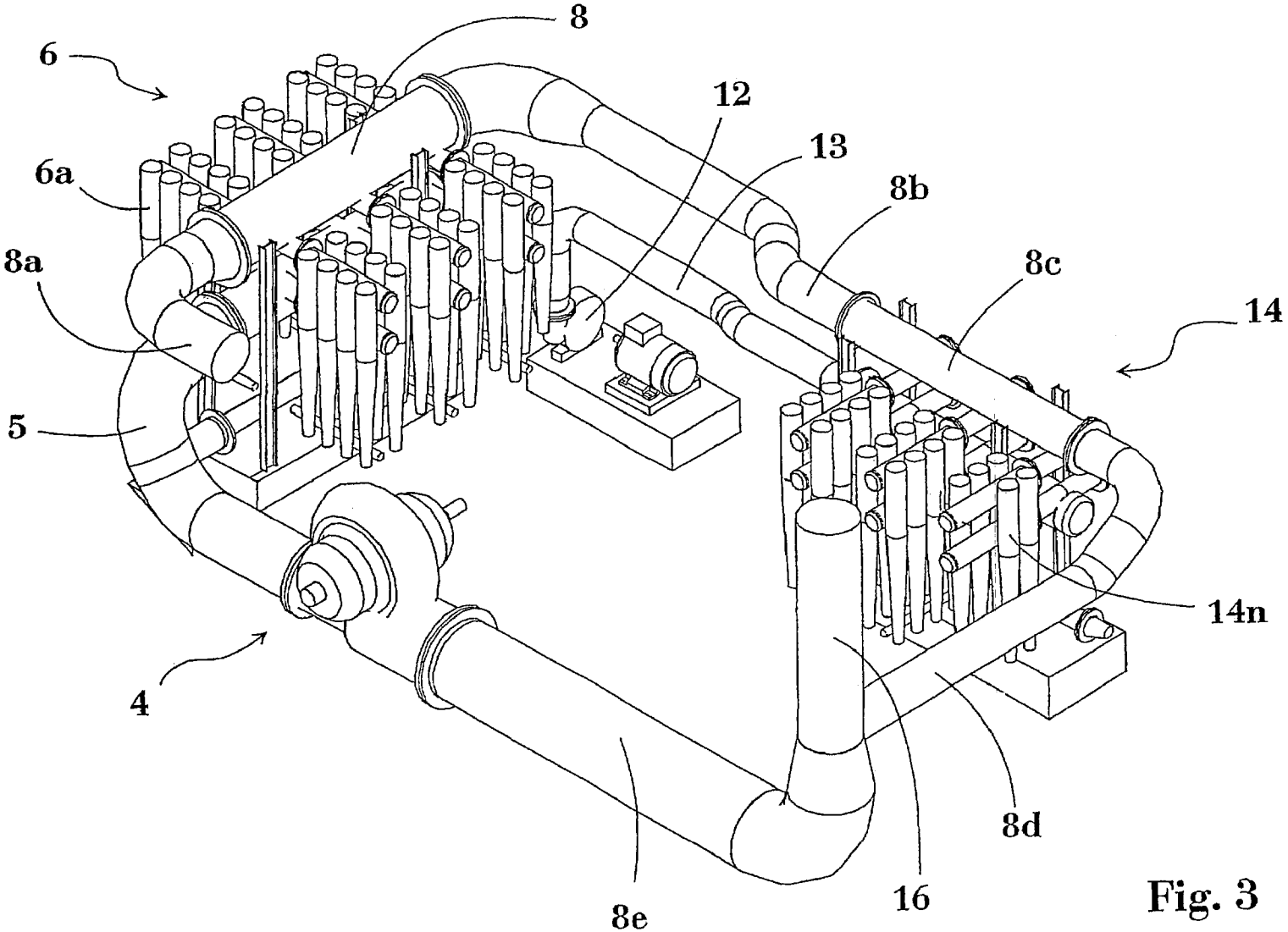

FIG. 3 shows the described system in a perspective view from which the means for regulating the mass flow out of the system and some other components have been omitted for ease of illustration. The Figure shows the first cleaning stage 6 and the second cleaning stage 14 as well as the central piping 8 which is composed of pipe sections 8*a*–8*d*–8*c*–8*e*–8*b* which lead from the circulation pump 4 to the outlet and which also extend past the accept outlets of the cleaning stages 6, 14.

The above text describes some preferred embodiments of the invention but for the person skilled in the art it is evident that the invention may be operated in many other ways within the scope of the appended claims. For instance, arrangements are envisaged wherein accept and/or reject from certain cleaning stage(s) is not led in the same way as that of the other cleaning stages but is instead led to some kind of special treatment.

The invention claimed is:

1. A process for directing a papermaking pulp, comprising a liquid and components of a more solid character, said process comprising directing said pulp towards a regulated outlet, whereby said pulp is led via a feeding pipe to a first cleaning stage from which an accept is primarily led towards said outlet, wherein reject from said first cleaning stage is led for further treatment to a respective inlet of at least one succeeding cleaning stage, whereby the accept from said first cleaning stage as well as accept from said at least one succeeding cleaning stage is induced, in turn, to be directed completely or partly towards said outlet while those portions of said accept which are not directed towards said outlet are induced to be directed in the opposite direction towards said feeding pipe to said first cleaning stage;

wherein the accept from at least two successive cleaning stages is led to a base pipe, which is common for respective cleaning stages and which leads in one direction to said outlet and in the other direction towards an inlet for pulp to said first cleaning stage, whereby regulating devices, optionally a pump, are utilized for allowing the flow in the common base pipe to be distributed so that it primarily flows towards said outlet and secondarily flows in the opposite direction towards said inlet, while pump means are used as regulating devices at the respective inlets to the respective cleaning stages in order to maintain a substantially continuous flow through the respective cleaning stages;

wherein diluting liquid is introduced for being mixed with the pulp at a point which is situated between that end of a base pipe which is connected to said inlet, in the flow direction ahead of pump means, and the pipe sections to which accept from said at least one succeeding cleaning stage is fed; and/or wherein diluting liquid is introduced, for being mixed with the pulp, to one end of the collecting reject pipes, which pipes at the other end, in the flow direction ahead of pump means, lead the pulp and any diluting liquid introduced therein to the inlet of the respective succeeding cleaning stage; and wherein said pulp is forwarded to a forming wire in a papermaking machine.

2. An arrangement for the feeding of a forming wire in a papermaking machine, said arrangement comprising feeding means for feeding or addition of a papermaking pulp comprising a liquid and components having a more solid character, to the forming wire, a first outlet controlled by a regulating device, optionally a pump, a first cleaning stage, wherein said feeding means comprises pump means for feeding said pulp via an inlet or feeding pipe to said first cleaning stage whereby at least one accept outlet, optionally an accept pipe, is connected to a base pipe one end of which is connected to said first outlet wherein reject outlets from said first cleaning stage are connected via a respective collecting reject pipe to a respective inlet of at least one succeeding cleaning stage the accept outlet of which, in its turn, is/are connected to a succeeding section of said base pipe, said section at its other end, in its turn, being connected to an entrance inlet to said pump means for feeding of pulp to said inlet or feeding pipe;

wherein means, optionally pipes, are provided for introducing diluting liquid to said base pipe and optionally to said collecting reject pipe(s) for the feeding of reject to said at least one succeeding cleaning stage;

wherein introduction of diluting liquid is provided, when calculated from said outlet, behind the respective accept outlet or accept pipe from said first cleaning stage and ahead of said inlet to said pump means, optionally at a distance from said inlet.

3. An arrangement for the cleaning of papermaking pulp comprising a liquid and components of a more solid character, said arrangement comprising an inlet or feeding pipe for feeding of pulp to a first cleaning stage and a regulated outlet leading to consumption, to a forming wire in a papermaking machine, said inlet or feeding pipe being controlled by a regulating device, optionally a pump, and said outlet being controlled by a regulating device, optionally a pump, wherein said arrangement comprises at least one second cleaning stage such that accept outlets from the respective cleaning stages are successively connected to a common base pipe one end of which is connected to said regulated outlet and the opposite end of which is connected to an entrance inlet to said regulating device, optionally said pump, for feeding said first cleaning stage, the reject outlets from said first cleaning stage and the respective reject outlets of successively arranged cleaning stages being connected to an inlet to a respective succeeding cleaning stage;

wherein introduction, optionally by pipes, of diluting liquid is arranged in said common base pipe and/or in connection to a respective reject outlet pipe from a respective preceding cleaning stage.

* * * * *